United States Patent [19]

Hjorth

[11] Patent Number: 4,937,099

[45] Date of Patent: Jun. 26, 1990

[54] COATING METHOD AND COATING SLIP FOR SUBSTANTIALLY INORGANIC FIBROUS MATERIAL

[75] Inventor: Ingegerd Hjorth, Helsingborg, Sweden

[73] Assignee: Bilsom AB, Billesholm, Sweden

[21] Appl. No.: 314,045

[22] Filed: Feb. 22, 1989

[30] Foreign Application Priority Data

Feb. 26, 1988 [SE] Sweden ..... 8800660

[51] Int. Cl.[5] ..... B05D 1/00

[52] U.S. Cl. ..... 427/209; 106/204; 427/389.8; 427/391

[58] Field of Search ..... 427/209, 211, 382, 391, 427/389.8; 106/204

[56] References Cited

U.S. PATENT DOCUMENTS 4,391,833 7/1983 Self et al. ..... 427/382 X

FOREIGN PATENT DOCUMENTS 0001539 4/1979 European Pat. Off. .
0003214 8/1979 European Pat. Off. .
2911679 9/1980 Fed. Rep. of Germany .
442171 12/1985 Sweden .
2031475 4/1980 United Kingdom .
1597369 9/1981 United Kingdom .

OTHER PUBLICATIONS

M. Rafiuddin, Paper Chem., Dialog Abstract (Dialog Accession No. 308665).

*Primary Examiner*—Michael Lusignan
*Attorney, Agent, or Firm*—Merchant, Gould, Smith, Edell, Welter & Schmidt

[57] ABSTRACT

A coating slip and a method of coating a fibrous sheet material are disclosed. The coating slip comprises 60–90% by weight pigment consisting of a mixture of talc and soapstone, 10–50% by weight anionic polyelectrolyte, 0–5% by weight thickener, and water in an amount such that the dry solids content of the coating slip will be 60–95% by weight. The weight ratio of talc:soapstone is preferably from about 30:70 to about 70:30, and the talc preferably has a mean particle diameter of about 10–20 μm, while the soapstone preferably has a mean particle diameter of about 5–10 μm. Upon coating, the sheet material is coated on one or both of its sides with preferably about 30–100 g dry material per square meter and side.

10 Claims, No Drawings

COATING METHOD AND COATING SLIP FOR SUBSTANTIALLY INORGANIC FIBROUS MATERIAL

The present invention relates to a coating slip and to a method for coating fibrous sheet material.

In the production of fibrous sheet materials, such as paper, the surface coating of the sheet material constitutes a standard operation for improving the printing characteristics of the sheet material, such as brightness, opacity and ink absorbency. Fibrous sheet materials, such as paper, are coated in order to eliminate the roughness caused by the size and distribution of the fibres. The fibres are irregular in themselves so that hollows and pits are formed therebetween. By applying to the surface of the sheet material a coating slip, pores and irregularities in the surface are filled up, and a smoother and more homogeneous surface is obtained. The coating also makes it possible to control the tendency of the sheet material to absorb various materials. To make this work, the applied coating slip must be strongly bonded to the sheet material and tolerate further treatment with other materials.

In conventional coating of paper, use is made of different pigments in the slip to impart to the paper a high and stable brightness and opacity as well as high gloss.

Coating can be effected on the paper machine during production of the sheet material, or in a separate coating plant.

Depending on the manner in which coating is carried out, one distinguishes between blade coating, air knife coating, bar coating, roll coating, size press coating and cast coating.

In conventional coating of sheet material, such as paper, there is applied to one or preferably both sides of the sheet material a coating slip which is a composition consisting of pigment, binder and water. The pigment may be, for example, clay, titanium dioxide or talc. When the coating slip has been applied to the sheet material, the water and, to some extent, the binder and, to a less extent, the pigment will penetrate into the surface of the sheet material. The binder must penetrate to some extent, such that the coating layer will be firmly bonded to the sheet material. If the binder penetrates too far, the binder in the coating layer will be depleted with the ensuing risk of an inferior surface strength. An insufficient penetration depth gives an inferior bond. These circumstances can be influenced by the sizing of the sheet material and its air resistance and, of course, by the composition of the coating slip.

Too much size in the sheet material reduces the wetting ability of the coating slip and causes an inferior bond between the coating layer and the sheet material. If, on the other hand, the paper is too open or porous, the wetting will be too quick, resulting in a depletion of binder in the coating layer.

The present invention provides a coating slip which is especially well suited for high-porous, essentially inorganic fibrous materials. Even though the coating slip according to the invention is especially useful for the coating of such sheet materials, it can of course be used also for coating other types of porous and nonporous fibrous sheet materials, both inorganic and organic.

The coating slip according to the invention is characterised in that it contains as pigment a mixture of talc and soapstone.

More particularly, the coating slip of the present invention is characterised in that it comprises 60–90% by weight pigment consisting of a mixture of talc and soapstone, 10–50% by weight anionic polyelectrolyte, 0–5% by weight thickener, and water in an amount such that the dry solids content of the coating slip will be 60–95% by weight.

Furthermore, the invention provides a method of coating a fibrous sheet material, the method being characterised in that the sheet material is provided on at least one side with a coating of the above-mentioned coating slip.

These and other characteristic features of the invention will appear in more detail from the following description and the appended claims.

By coating, in accordance with the invention, a preferably substantially inorganic fibrous sheet material, it is possible to (a) improve the dimensional stability of the sheet material, (b) eliminate fibre rising in the surface of the sheet material, (c) improve the strength values of the sheet material, and (d) obtain quicker application and a smoother surface during the subsequent coating of the sheet material with, for example, polyvinyl chloride foam.

Of the constituents of the coating slip according to the invention, the pigment or filler is an especially characteristic and significant constituent and consists of a mixture of talc and soapstone.

The generic term "talc" usually includes (a) the mineral talc, (b) steatite, which is a compact variant of talc, and (c) the rock type soapstone.

The mineral talc is a hydrated magnesium silicate of the ideal composition $Mg_3Si_4O_{10}(OH)_2$. The talc content of commercial talc is high and usually lies at about 97% by weight. For the production of commercial talc, talc mineral is crushed and comminuted and then purified by flotation to provide a talc product having a high talc content and whiteness.

Soapstone is a natural product consisting mineralogically of talc in mixture with a high content of chlorite and minor amounts of carbonate and amphibole. For example, soapstone from Handöl in Sweden has the following mineral composition

| | | |
|---|---|---|
| talc | about | 67% by weight |
| chlorite | about | 18% by weight |
| carbonate | about | 8% by weight |
| amphibole | about | 3% by weight |
| ore material | about | 4% by weight |

For maximum results, the talc and the soapstone in the coating slip of the invention should have different mean particle sizes. Thus, it is preferred that the talc has a mean particle size of about 10–20 μm, while the soapstone is fine grained or micronised and has a mean particle size of about 5–10 μm. The relative proportions of talc and soapstone in the pigment of the invention may vary within wide limits, preferably from a weight ratio of about 30:70 to about 70:30, more preferred from about 40:60 to about 60:40, and most preferred about 50:50. The pigment content in the coating slip of the invention may also vary within wide limits, and is generally about 60–90% by weight, preferably about 75–85% by weight.

In addition to the pigment described above, the coating slip according to the invention also includes an anionic polyelectrolyte as binder.

A polyelectrolyte is a polymer having the character of an electrolyte, which means that, like an electrolyte, it is dissociated in aqueous solution in ions and is electrically conductive. Depending on whether the polymer backbone is positively or negatively charged upon dissociation, the polyelectrolyte is said to be cationic or anionic, respectively. The starting material of cationic polyelectrolytes are derivatives of esters and amides. A characteristic feature of these polyelectrolytes is an ammonium group which may be present in the form of a salt of tertiary amine, or as a quaternary ammonium group. The starting material for anionic polyelectrolytes usually is acrylic and methacrylic acid.

The anionic polyelectrolyte is included in such an amount that it forms, together with the cationic constituents (talc and soapstone) of the coating slip, a charge neutral system. Generally, the anionic polyelectrolyte is a diluted aqueous solution having a concentration of about 10–35% by weight. Since anionic polyelectrolytes are per se well known, a detailed enumeration thereof would not seem necessary. As examples, however, mention may be made of the flocculating polymers commercially available under the trade name Prestol, for example Prestol 2935/74 which is manufactured by Stockhausen, and of the anionic polyelectrolyte Prodefloc N2M from the company Prodeco in Italy, and PLEX 4911 from the company Röhm GmbH. The content of anionic polyelectrolyte in the coating slip of the invention is generally about 10–50% by weight, preferably about 10–40% by weight, and most preferred about 15–20% by weight.

In addition to water, the above-mentioned constituents pigment and anionic polyelectrolyte are the indispensible constituents of the coating slip according to the invention. To control the viscosity of the coating slip, it is also possible, if desired or necessary, to add a thickener in a content of up to about 5% by weight, preferably up to about 1% by weight, based on the total weight of the coating slip. A variety of thickeners are well known in the art, and a detailed enumeration therefore would not seem necessary. However, various cellulose derivatives, such as carboxy methyl cellulose, may be mentioned as examples of suitable thickeners in the context of this invention.

As mentioned above, the coating slip contains water, more particularly in an amount such that the dry solids content of the coating slip will be about 60–95% by weight, preferably about 80% by weight. This water also includes water supplied with the other components of the coating slip, such as the anionic polyelectrolyte which normally is available in the form of an aqueous solution having a concentration of about 10–35% by weight.

In carrying the method according to the invention into effect, the above-mentioned coating slip is applied to a fibrous sheet material, using any of the different coating techniques mentioned in the introduction. At present, blade coating is preferred for application on the paper machine, and roll coating for separate coating outside the paper machine. The coating may be one-sided or double-sided, i.e. one or both sides of the sheet material can be coated. The amount of coating slip applied during coating preferably is about 30–100 g dry material per square meter of sheet material and side.

As has been indicated above, the coating slip of the invention is especially well suited for coating high-porous, substantially inorganic fibrous materials. Usually, it is extremely difficult to coat such sheet materials with conventional coating slips because these slips penetrate too far into the sheet material. To prevent this, the sheet material must first be impregnated, and this is a further expensive and time-consuming treatment step which is obviated by the coating slip according to the invention which can be directly applied to such high-porous sheet materials without previous impregnation. A further advantage in the context is that the application of further coating layers, such as unfoamed or foamed layers of polyvinyl chloride, polyurethane or phenol plastic, on the coated sheet material can be carried out with far less consumption of material than is otherwise the case, for example 120 g/m$^2$ as compared with 270 g/m$^2$.

A substantially inorganic fibrous sheet material for which the coating slip of the invention is specially suitable, is of the type including

- 1–80% of cationic inorganic filler comprising a mixture of talc and soapstone,
- 1–80% by weight of cationic inorganic fibres, such as surface-treated glass fibres,
- 3–20% by weight of anionic binder comprising an anionic polyelectrolyte, and
- 2–20% by weight of a strength-improving additive comprising thermoplastic polymer particles.

In this sheet material, the talc and the soapstone are preferably present in a weight ratio of about 30:70 to 70:30, and the talc preferably has a mean particle diameter of about 10–20 μm, while the soapstone preferably has a mean particle diameter of 5–10 μm.

The anionic binder may comprise up to about 8% by weight of cellulose fibres.

In order to produce a substantially charge-neutral sheet material from the ionic constituents comprised by the sheet material, the latter may further comprise up to about 2% by weight of a cationic polyelectrolyte as charge controlling agent.

The above-mentioned particular type of sheet material has a variety of applications, for example in wall, floor and roof covering materials (e.g. in roofing felt), and in foamed products, such as polyurethane, polyvinyl chloride and phenol plastics. The sheet material may be included as a carrier or backing material, but may also be included as, for example, an intermediate layer, or be used separately.

To illustrate the invention, the following non-restrictive Examples are given. Since the invention is especially useful for the above-mentioned type of substantially inorganic fibrous sheet material, it will be described below with reference to the coating of such a sheet material. In view hereof, the production of the sheet material proper is first described in Examples 1–3, while the coating of these sheet materials is described in the subsequent Examples 4–6.

EXAMPLES 1–3

Production of sheet material

Three pieces of sheet material were produced, using the constituents and the contents (% by weight) indicated in Table 1.

The soapstone used in the Examples was of type H340 from Handöl, Sweden. This is a micronised soapstone having a mean diameter of 5–10 μm. The talc content is about 67% by weight, and the loss on ignition about 8% by weight. The oil absorption value is 55 g oil/100 g soapstone, and the melting point is 1500° C.

The talc used in the Examples was of the type Finntalk P40 from Outokumpu Oy, Finland, which has a mean diameter of about 10–20 μm, a talc content of about 97% by weight, a loss on ignition of 7% by weight, and an oil absorption value of 32 g oil/100 g talc. The melting point is 1375° C.

The thermoplastic particles used in the Examples were polyvinyl alcohol flakes of the type Moviol from Hoechst and polypropylene fibres of the type Pulpex P from Herkules.

TABLE 1

| Examples | 1 | 2 | 3 |
|---|---|---|---|
| Glass fibres (cationic, length 10 mm, diameter 3 μm) | 20 | 35 | 29 |
| Soapstone | 40 | 33 | 25 |
| Talc | 28 | 13 | 25 |
| Cellulose (long-fibre pine sulphate cellulose which has been beaten and bleached, 95° SR) | 4 | 6 | — |
| Cationic polyelectrolyte (ROHAFLOC KL 925 from Rohm) | 0.5 | 1.0 | — |
| Anionic polyelectrolyte (PLEX 4911 from Rohm) | 5 | 7 | 10 |
| Thermoplastic particles (PVA) | 2.5 | 5 | 11 |

First about 1.0 kg $CaCl_2/m^3$ $H_2O$ is added to the stock water to give a water hardness of 23° dH. Then the cationic glass fibre is added and slushed to a slurry having a concentration of about 1.0% by weight. To the slurry, the cationic soapstone and the talc are admixed. The soapstone is greyish-green, and the talc practically white. In those cases where the composition includes cellulose fibres, these are also supplied to the slurry.

Then the anionic polyelectrolyte is added, and the system now begins to turn into a charge-neutral system. To ensure that the system is indeed a charge-neutral system, the cationic polyelectrolyte is added in several (two) doses. Finally, the thermoplastic particles are added to the charge-neutral system.

The resulting slurry or stock is supplied to the paper machine, and the water is sucked off immediately ahead of the drying section. The first part of the drying section has been heated to maximum temperature (about 90°–120° C.) to rapidly increase the dry strength of the sheet. After the drying section, the sheet is hot-calendered at a pressure of 23N/mm.

The properties of the sheet materials thus produced were then tested, and the results obtained are indicated in Table 2.

TABLE 2

| Examples | 1 | 2 | 3 |
|---|---|---|---|
| Grammage, g/m² | 130 | 135 | 132 |
| Thickness, mm | 0.163 | 0.151 | 0.175 |
| Density, g/dm³ | 798 | 894 | 754 |
| Air resistance No. (Gurley), s | 5 | 4 | 2 |
| Tensile index, machine direction | 15.2 | 18.3 | 33.9 |
| Tensile index, cross direction | 7.9 | 8.9 | 16.2 |
| Elongation, machine direction, % | 2.1 | 1.6 | 4.2 |
| Elongation, cross direction, % | 1.5 | 1.7 | 4.6 |
| Dimensional stability, machine direction %* | 0.13 | 0.14 | 0.12 |
| Dimensional stability, cross direction %* | 0.16 | 0.16 | 0.14 |

TABLE 2-continued

| Examples | 1 | 2 | 3 |
|---|---|---|---|
| Z-strength, kPa | 183 | 158 | 222 |
| Coal ash % | 88 | 81 | 79 |

*The values of dimensional stability are the difference in percent in the machine and cross directions, respectively, of the dimensions of the material before and after soaking in water for 10 min.

EXAMPLES 4–6

Coating of the sheet material

Three coating slips were produced, using the constituents and the contents (% by weight) indicated in Table 3.

TABLE 3

| Examples | 4 | 5 | 6 |
|---|---|---|---|
| Anionic polyelectrolyte | 10 | 20 | 15 |
| Water | 20 | 10 | 5 |
| Talc | 21 | 49 | 40 |
| Soapstone | 49 | 21 | 40 |

The anionic polyelectrolyte was of the type PLEX 4911 from Röhm and was present in the form of a 35% by weight aqueous solution. The talc was of the same type as in Examples 1–3. Also the soapstone was of the same type as in Examples 1–3. After the production of the sheet material in Examples 1–3, the finished sheet material was coated with the above-mentioned coating slip by roll coating technique. The coating slip according to Example 4 was used for coating the sheet material according to Example 1, the slip according to Example 5 for coating the sheet material according to Example 2, and the slip according to Example 6 for coating the sheet material according to Example 3. Only one side was coated, and the coating slip was applied in an amount such that the surface weights indicated in Table 4 were obtained. Table 4 also shows the other characteristics of the sheet materials after coating.

TABLE 4

| Examples | 4 | 5 | 6 |
|---|---|---|---|
| Grammage, g/m² | 160 | 165 | 162 |
| Thickness, mm | 0.17 | 0.16 | 0.18 |
| Density, g/dm³ | 941 | 1031 | 900 |
| Tensile index, machine direction | 16.1 | 19.4 | 34.6 |
| Tensile index, cross direction | 8.2 | 9.3 | 17.0 |
| Elongation, machine direction, % | 2.1 | 1.6 | 4.2 |
| Elongation, cross direction, % | 1.5 | 1.7 | 4.6 |
| Dimensional stability, machine direction %* | 0.11 | 0.12 | 0.10 |
| Dimensional stability, cross direction %* | 0.13 | 0.14 | 0.12 |
| Z-strength, kPa | 183 | 158 | 222 |
| Coal ash % | 88 | 81 | 79 |

*The values of dimensional stability are the difference in percent in the machine and cross directions, respectively, of the dimensions of the material before and after soaking in water for 10 min.

EXAMPLE 7

Coating of a cellulosic sheet material

A cellulosic paper consisting of 100% unbleached pine sulphate pulp having a degree of beating 14° SR was coated with the coating slip according to Example 6 in Table 3. Testing of the uncoated and the coated paper, respectively, gave the values indicated in Table 5.

TABLE 5

| | Uncoated | Coated |
|---|---|---|
| Grammage, g/m$^2$ | 100 | 130 |
| Thickness, mm | 0.14 | 0.155 |
| Density, g/dm$^3$ | 714 | 839 |
| Air resistance No. (Gurley), s | 12 | 35 |
| Tensile index, machine direction | 36.6 | 38.5 |
| Tensile index, cross direction | 15.7 | 17.2 |
| Elongation, machine direction, % | 1.7 | 1.9 |
| Elongation, cross direction, % | 3.9 | 4.2 |
| Z-strength, kPa | 105 | 105 |

It appears from Table 5 that the Z-strength has remained unaffected, which shows that the coating did not penetrate into the material, in spite of the fact that the paper is an "open" paper (Gurley 12). This means that the coating stays on the surface, and it will be appreciated that the coating slip according to the invention this can also be used for sheet material of cellulose only, such as an open or porous paper.

I claim:

1. Coating slip for coating fibrous sheet material, comprising

60–90% by weight pigment consisting of a mixture of talc and soapstone,

10–50% by weight anionic polyelectrolyte,

0–5% by weight thickener, and water in an amount such that the dry solids content of the coating slip will be 60–95% by weight.

2. Coating slip as claimed in claim 1, wherein the weight ratio of talc:soapstone is from about 30:70 to about 70:30.

3. Coating slip as claimed in claim 1, wherein the weight ratio of talc:soapstone is from about 40:60 to about 60:40.

4. Coating slip as claimed in claim 1, wherein the talc has a mean particle diameter of about 10–20 μm, and the soapstone has a mean particle diameter of about 5–10 μm.

5. Coating slip as claimed in claim 1, wherein the dry solids content of the slip is about 80% by weight.

6. Coating slip as claimed in claim 1, comprising 15–20% by weight of anionic polyelectrolyte.

7. Coating slip as claimed in claim 1, comprising a thickener, preferably carboxy methyl cellulose.

8. A method of coating a fibrous sheet material, wherein the sheet material on at least one side is provided with a coating of a coating slip comprising 60–90% by weight pigment consisting of a mixture of talc and soapstone, 10–50% by weight anionic polyeletrolyte, 0–5% by weight thickener and water in an amount such that the dry solids content of the coating slip will be 60–95% by weight.

9. A method as claimed in claim 8, wherein the sheet material is coated on one or both of its sides.

10. A method as claimed in claim 8, wherein the sheet material is coated with 30–100 g of dry material per square meter and side.

* * * * *